US007780482B2

(12) United States Patent
Daubigney

(10) Patent No.: US 7,780,482 B2
(45) Date of Patent: Aug. 24, 2010

(54) MINIATURE ELECTRICAL CONNECTOR WITH EXTRACTABLE CONTACT ELEMENTS AND ASSOCIATED TOOL FOR UNLOCKING AND EXTRACTING THE CONTACTS

(75) Inventor: Patrick Daubigney, Authume (FR)

(73) Assignee: CoActive Technologies, Inc., Greenwich, CT (US)

( * ) Notice: Subject to any disclaimer, the term of this patent is extended or adjusted under 35 U.S.C. 154(b) by 109 days.

(21) Appl. No.: 12/262,708

(22) Filed: Oct. 31, 2008

(65) Prior Publication Data

US 2009/0111335 A1 Apr. 30, 2009

(30) Foreign Application Priority Data

Oct. 31, 2007 (FR) ..... 07 58737

(51) Int. Cl.
*H01R 13/426* (2006.01)

(52) U.S. Cl. ..... 439/745

(58) Field of Classification Search ..... 439/744, 439/745, 871, 848, 723, 787, 886, 775
See application file for complete search history.

(56) References Cited

U.S. PATENT DOCUMENTS 3,478,305 A * 11/1969 Chirumbolo ..... 439/744
3,560,911 A * 2/1971 Zimmerman, Jr. et al. .. 439/848
3,697,935 A * 10/1972 Drapkin ..... 439/744
4,269,472 A 5/1981 Shaffer et al.
4,653,842 A * 3/1987 Kirma ..... 439/712
4,701,004 A * 10/1987 Yohn ..... 439/871
5,538,445 A 7/1996 Grzybowski et al.
5,575,691 A * 11/1996 Matthews ..... 439/744
5,934,945 A * 8/1999 Petersen et al. ..... 439/744
6,957,988 B2 * 10/2005 Kieninger et al. ..... 439/744
7,101,192 B1 * 9/2006 Bordeau et al. ..... 439/66

FOREIGN PATENT DOCUMENTS

FR 1555635 A 1/1969
FR 2459562 A1 1/1981
FR 2326791 4/1997
WO 98/31076 7/1998

* cited by examiner

*Primary Examiner*—Alexander Gilman
(74) *Attorney, Agent, or Firm*—Pepper Hamilton LLP

(57) ABSTRACT

An electrical connector may include an insulating body including a series of at least two parallel and adjacent longitudinal cells which may be aligned. The electrical connector may include a series of electrical contact elements, each of which may include a locking section which may include at least one locking notch and which may be configured to be received axially in one of the cells and to be axially immobilized therein. The electrical connector may include a series of locking elements each of which may be configured to retain axially, at least towards the rear, a locking section of an associated electrical contact element. Each locking element may include a locating base fixed axially relative to the insulating body and at least one locking finger, a free end of which may be received in a locking notch of the associated contact element to retain it axially, wherein each base may be arranged outside the locking section of the associated cell.

8 Claims, 10 Drawing Sheets

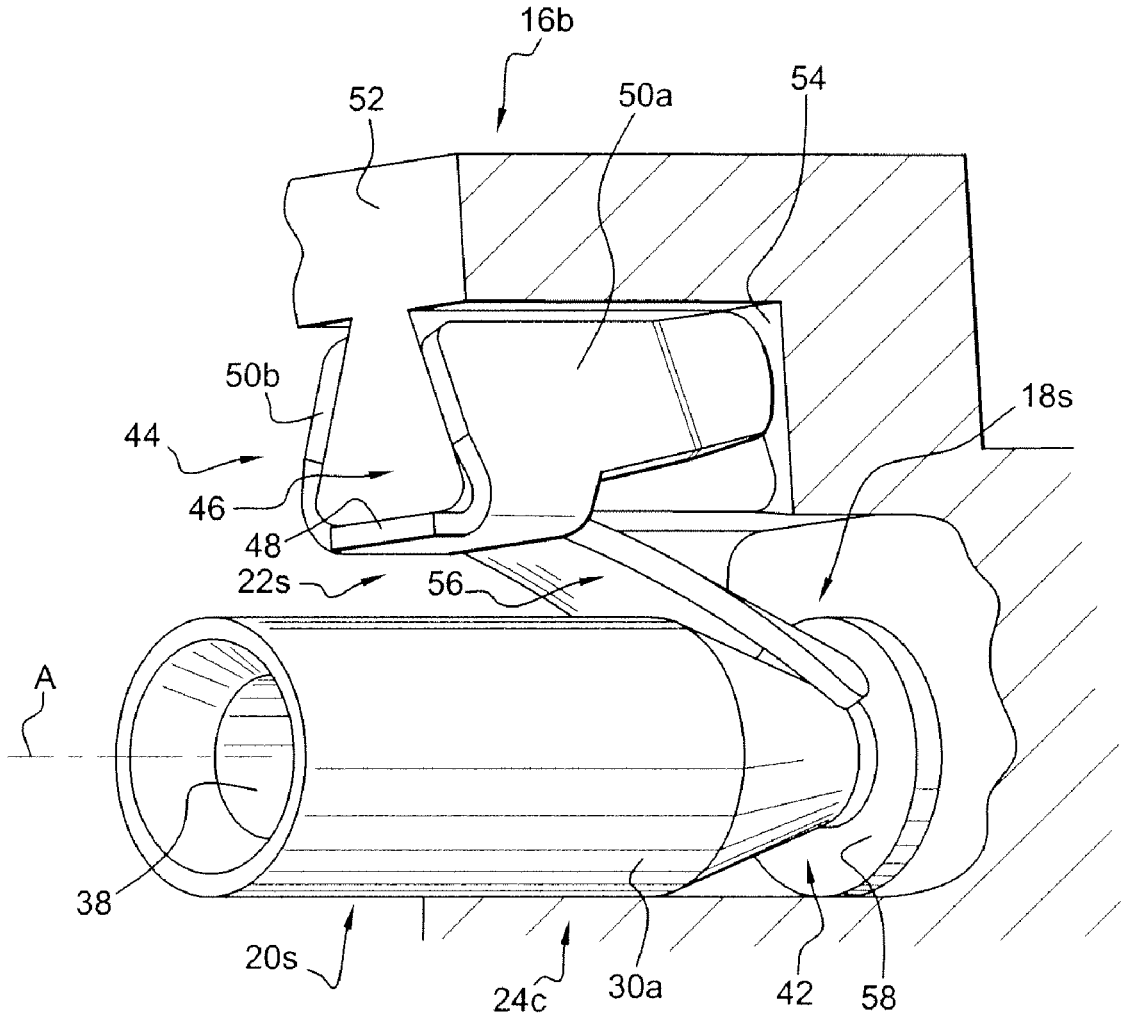
Fig. 5
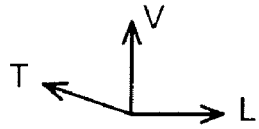

MINIATURE ELECTRICAL CONNECTOR WITH EXTRACTABLE CONTACT ELEMENTS AND ASSOCIATED TOOL FOR UNLOCKING AND EXTRACTING THE CONTACTS

CROSS-REFERENCE TO RELATED APPLICATION

This application claims the benefit of priority to French Patent Application No. 0758737, filed Oct. 31, 2007, which is hereby incorporated by reference in its entirety.

Not Applicable

BACKGROUND

An electrical connector, of which the first end section of each electrical contact element is connected in a non-dismantlable way in the insulating body of the connector, is not suited to a use that can entail replacing a wire or an electrical contact element, or even inverting a wire or an electrical contact element with another. A type of connector with extractable electrical contact elements is known, which, in theory, may be adapted to such a use.

In a known manner, each locking element comprises an annular base in the form of a socket which extends axially in a fixed manner into an associated cell, and each locking socket comprises at least one elastically deformable locking finger which extends radially towards the axis from the base in socket form. Each base or socket is passed through axially by a corresponding section of the electrical contact element for which it provides the axial locking function.

The finger projects radially inside the associated cell and comprises a free end which is received in a locking notch of the intermediate locking section of the associated electrical contact element, in order to axially retain the electrical contact element. The unlocking of the electrical contact element is achieved by elastically deforming the locking finger to retract it radially towards the outside out of the notch of the locking section of the electrical contact element.

A connector of this type is not entirely satisfactory, notably for the production of a connector with small footprint, such as a connector of the so-called "micro miniature" type, notably a connector with requirements defined in standards ESA/ESCC 3401-029 and MIL-DTL-83513.

In practice, the base socket of the locking element, from which extends the locking finger, is arranged inside the associated cell, radially between the facing sections of the electrical contact element and of the associated cell, so that the useful internal diameter of the cell is, to this end, necessarily greater than the outer diameter of the electrical contact element.

Consequently, with equal useful diameter, the radial footprint of such an assembly, comprising a cell and an associated locking element, is greater than the footprint of a "conventional" connector not comprising such locking elements. Now, reducing this radial footprint may be a design constraint in the field of so-called "micro miniature" type connectors.

Also known, is an electrical connector which includes a plurality of locking elements for locking an associated contact element, each locking element comprising a base with reduced radial footprint. This connector, described in document FR-A-2,459,562, has an insulating body which delimits two adjacent cells in each of which can be longitudinally inserted an associated electrical contact element.

The connector comprises a series of locking elements, or springs, for locking each contact element in the associated cell. Each locking element comprises a locating base which is fixed in the insulating body of the connector and a locking finger which cooperates with a locking notch of the associated contact element. More specifically, the base of each locking element comprises two tabs which extend axially and which can be inserted axially into associated grooves in the insulating body. Furthermore, the base of each locking element comprises a locking attachment which is interposed between the two tabs, and which engages automatically in a locking recess of the insulating body provided for this purpose. Finally, the locking recess opens out towards the exterior of the insulating body, to allow the passage of a tool in order to push the locking attachment to unlock the locking element.

This type of locking element presents the drawback of being difficult to lock and unlock in the insulating body. Furthermore, the locking by cooperation of a locking attachment and a locking recess, and the fixing by cooperation of a pair of tabs with associated grooves, do not allow for precise locking and fixing. Similarly, a fixing by gripping or by cooperation of a harpoon-type tab with an associated groove does not allow for a satisfactory fixing.

FIG. 1A represents a connector 110 according to the prior art, of which only two adjacent cells 112 are represented, for reasons of clarity. Each cell 112 is delimited by an internal cylindrical wall 114 of a diameter D1, a base socket 116 of a locking element which extends in the associated cell 112 inside the internal wall 114, and a locking finger 120 which extends radially towards the axis from the locking socket 118, in order to axially retain an electrical contact element (not represented). The two cells 112 represented in FIG. 1A are separated by a minimum portion of material P1mini and their axes are spaced apart by a minimum distance C1mini.

SUMMARY

An electrical connector may be able to house a series of dismantleable electrical contact elements, called extractable, each of which may be retained axially in an insulating body of the connector by an associated locking element.

In an embodiment, the electrical connector may relate to an associated tool for unlocking an electrical contact element.

In an embodiment, an electrical connector may include an insulating body including a series of at least two parallel and adjacent longitudinal cells which are aligned, each cell being open axially and leading into a rear face of the insulating body. The electrical connector may include a series of electrical contact elements, each of which may include a locking section which may include at least one locking notch which is able to be received axially in a section, called locking section, of one of said cells and to be axially immobilized therein. The electrical connector may include a series of locking elements each of which is able to retain axially, at least towards the rear, a locking section of an associated electrical contact element, each locking element including a locating base which may be fixed axially relative to the insulating body and which may be arranged outside the locking section of the associated cell, and at least one locking finger, which is elastically deformable, and which may extend from the base, which may project radially inside the locking section of the associated cell, and the free end of which may be received in a locking notch of the associated electrical contact element to retain it axially.

A connector may include at least one series of electrical contact elements, an insulating body including a series of parallel cells in which may be arranged the electrical contact elements in a parallel and adjacent manner, and an external casing which may surround the insulating body and which may include, for example, connector fixing mechanism.

Each electrical contact element of the connector may include an intermediate locking section which may be received in a locking section of an associated cell of the body of the connector and which may include a locking notch. Furthermore, the connector may include a series of locking elements, each of which may be able to axially retain an associated electrical contact element.

Each electrical contact element may include a first end section which is electrically connected to a wire, for example, by crimping or by soldering, and a second opposite end section which is able to be electrically connected, for example by insertion, to or in a complementary electrical contact element, which belongs, for example, to a complementary connector.

In an embodiment, an electrical connector, of which a base of each locking element does not reduce the useful diameter of an associated cell, proposes a connector with reduced footprint, that is, in which the axes of the adjacent and aligned electrical contact elements can be as close as possible, by making it possible to easily dismantle the electrical contact elements. Furthermore, an electrical connector may include a base of each locking element which may allow for simple and accurate fixing and locking in the insulating body.

In an embodiment, an electrical connector may be characterized in that the locating base of each locking element comprises: a plate from which the locking finger extends towards the front, and a first lateral wing and a second lateral wing which are facing one another so that the locating base may be of transversal section in the form of a dovetail, and in that each locating base may be able to be threaded axially onto a complementary part of the body of the connector.

In an embodiment, the locating base of each locking element may be fixed to the complementary part of the body of the connector by cooperating complementary forms, in order to retain the finger in the associated cell. The first lateral wing and the second lateral wing of the base can be substantially separated from each other by elastic deformation of the base, so that the first lateral wing and the second lateral wing may constitute a clamp which can elastically clamp the complementary part when the locking element is fixed, or elastically fitted, on said complementary part. Each locking element may be made of metal, and the insulating body and each complementary fixing part may be made of plastic material. Each locking element may be made by cutting and bending a metal plate. Each base may be radially offset relative to the locking section of the associated cell in a direction orthogonal to the transversal line of alignment of the cells. The bases of the locking elements associated with the cells may be aligned in a line parallel to the transversal line of alignment of the cells. Each locking finger may extend axially at an oblique angle from back to front inside the associated cell, so that the front free end of each finger extends facing a rear radial face of the notch of the locking section of the associated electrical contact element.

In an embodiment, a tool for unlocking an electrical contact element with a view to its axial extraction out of a connector may be characterized in that the tool may include an unlocking rod which is able to be driven axially from back to front between the locking section of an electrical contact element and the associated locking finger, from a rear rest position to a front unlocking position in which the unlocking rod elastically deforms the finger to retract it out of the notch of the locking section of the electrical contact element to axially unlock the latter. The tool may include an indexing pin which may extend axially towards the front from a transversal front face of the tool and which may be able to be received in a complementary recess provided for this purpose in the transversal rear face of the body of the connector, to transversally and axially position the unlocking rod opposite an associated cell of the connector. The took may include a positioning mechanism configured to angularly position the tool relative to the connector, which may include at least one axial plate which may be able to bear on a parallel complementary face of the connector, to angularly position the unlocking rod relative to the associated cell.

In an embodiment, the tool may include a sleeve which may be fixed on a rear section of the unlocking rod and which may make it possible to axially drive the unlocking rod into the associated cell from its rear rest position to its front unlocking position, a clamp for radially clamping the electrical contact element or a wire connected to the electrical contact element, of which two jaws are borne by the tool and are mounted to move one towards the other, between an open position and a closed gripping position, in which the two jaws clamp the wire or the electrical contact element, a clamping position that may be achieved when the unlocking rod occupies its front unlocking position, thanks to which the electrical contact element may be able to be extracted axially from the associated cell by displacing the tool towards the back. The tool may include a moving slide which extends axially relative to the unlocking rod and which may include a transversal front bearing face which may be able to bear axially on a transversal rear face of the connector, so that, when the unlocking rod of the tool may be driven towards its front unlocking position, the slide may be slid towards the back from a front rest position to a rear retracted position in which the unlocking rod may occupy its front unlocking position; and a first pusher and a second pusher which may extend facing each other from the slide, and which may be arranged either side of the unlocking rod and in front of the clamp, so that, while the slide is sliding towards the back, each pusher may be able to cooperate by transversal bearing with an associated jaw of the clamp, in order to drive the two jaws towards their gripping position when the slide may occupy its rear retracted position; the first and the second pushers may constitute a guiding mechanism configured to guide the wire, making it possible to axially guide the wire between the two jaws of the clamp; the tool may include a blocking mechanism configured to automatically block the slide in its retracted position, thanks to which the wire may be maintained automatically gripped in the clamp.

BRIEF DESCRIPTION OF THE DRAWINGS

Aspects, features, benefits and advantages of the embodiments described herein will be apparent with regard to the following description, appended claims, and accompanying drawings where:

FIG. 5 is a perspective detail view with cutaway, which illustrates a locking element comprising a locating base from which extends a locking finger according to an embodiment.

DETAILED DESCRIPTION

Figure 1A:
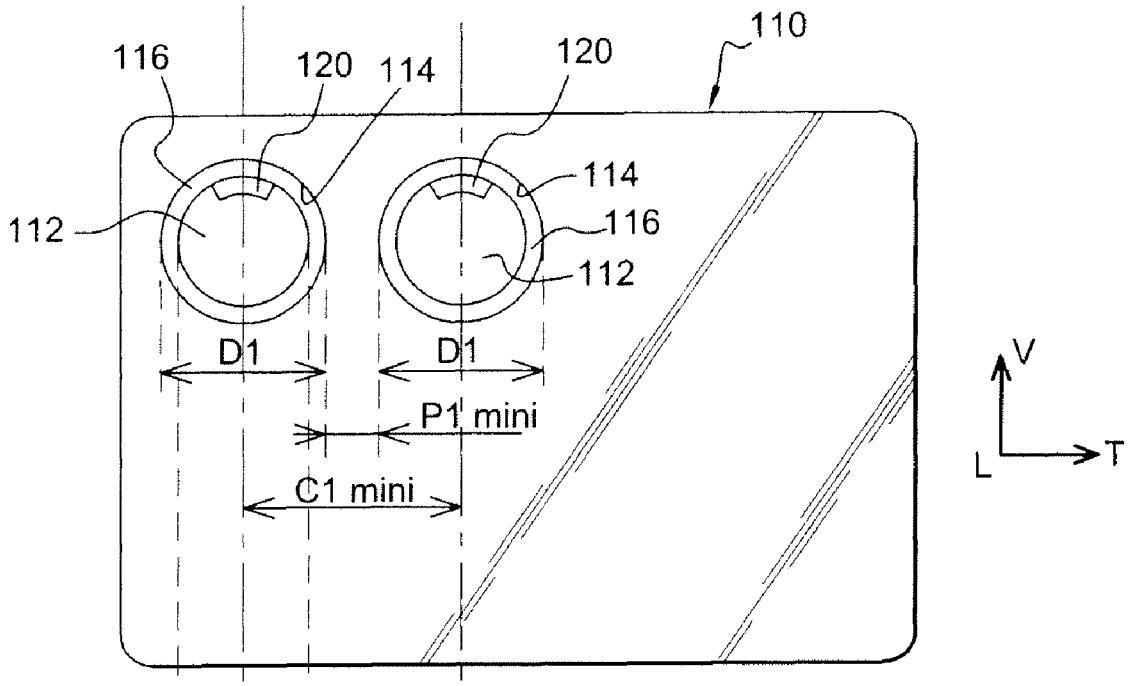
Fig. 1A PRIOR ART
FIG. 1A is a diagrammatic face view illustrating two adjacent cells of an insulating body of a "miniature" electrical connector according to the prior art, each cell housing a base socket of a locking element from which extends a locking finger of an electrical contact element of determined standard dimensions according to an embodiment.

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

As used herein, the use of the terms "vertical (V)," "longitudinal (L)," "transversal (T)," "top" and "bottom" are non-limiting and without reference to the earth's gravity and the elements may be depicted in any configuration. Additionally, identical, similar or analogous elements will be designated by the same reference numerals.

Figure 2:
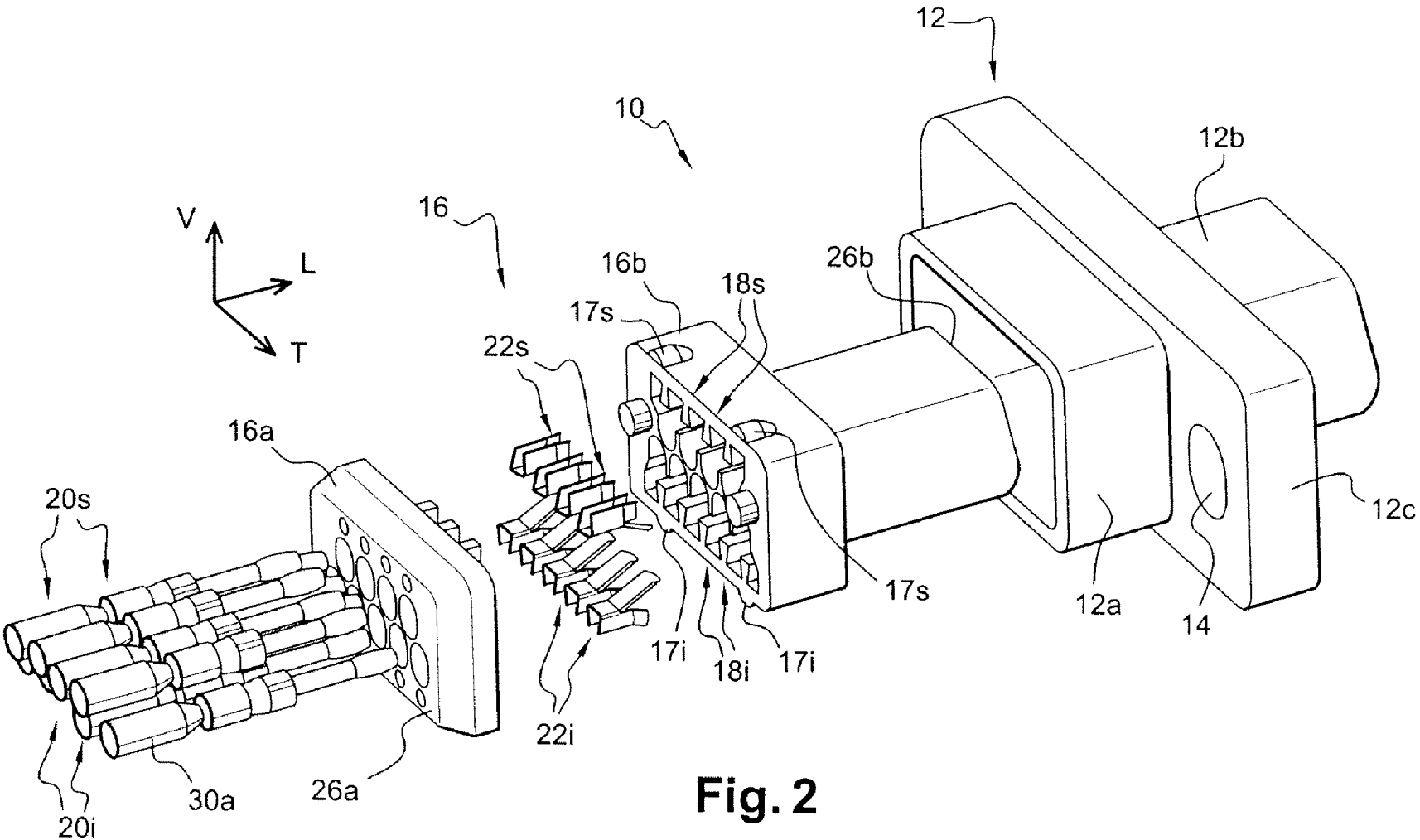
FIG. 2 is a perspective view exploded axially along a longitudinal axis illustrating, from left to right, electrical contact elements, a front part of the insulating body, the locking elements, a rear part of the insulating body and an external casing of a connector according to an embodiment.
Figure 3:
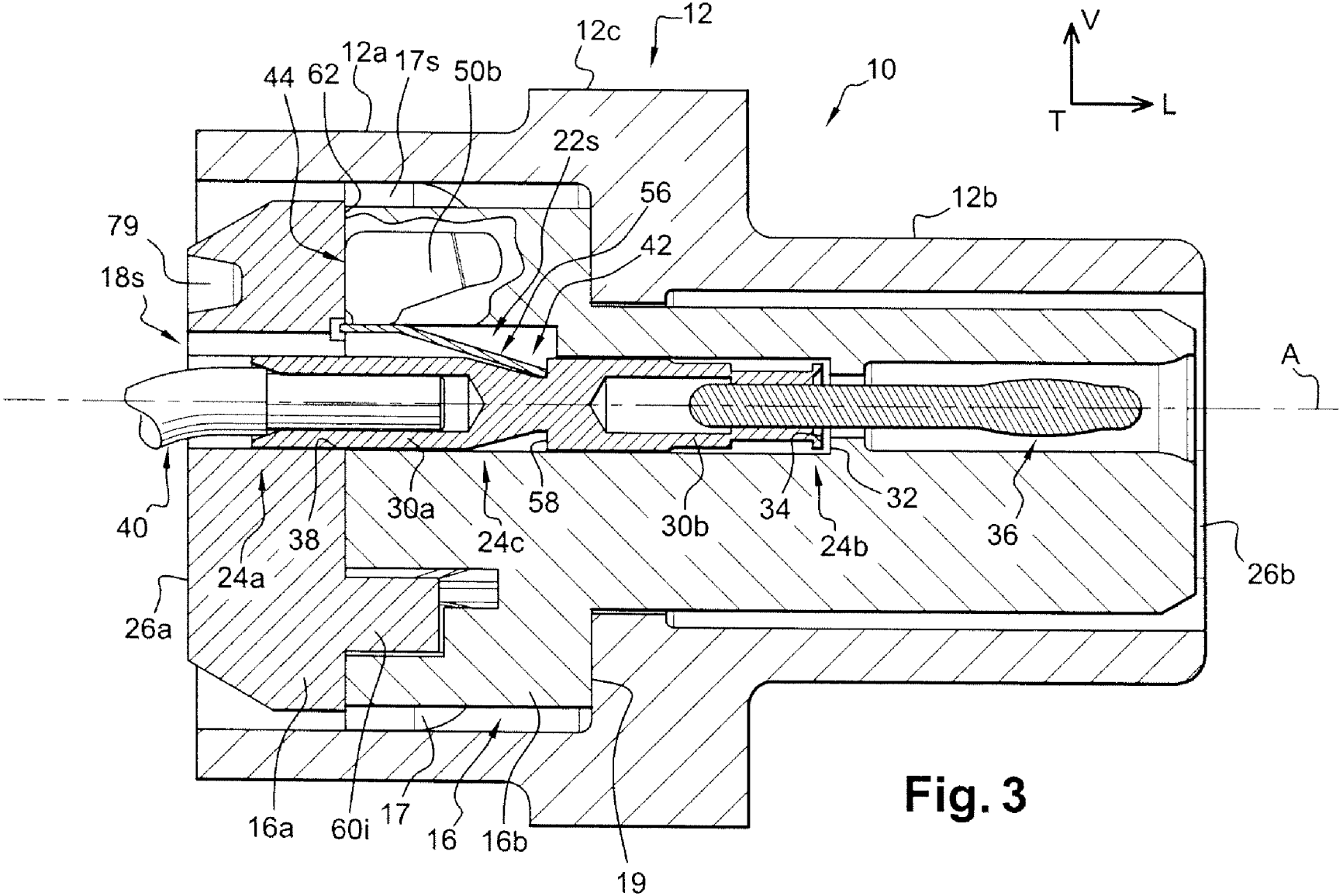
FIG. 3 is an axial section view with cutaway, representing an electrical contact element in its position locked by an associated locking element in a cell of the connector of FIG. 2 according to an embodiment.
Figure 4:
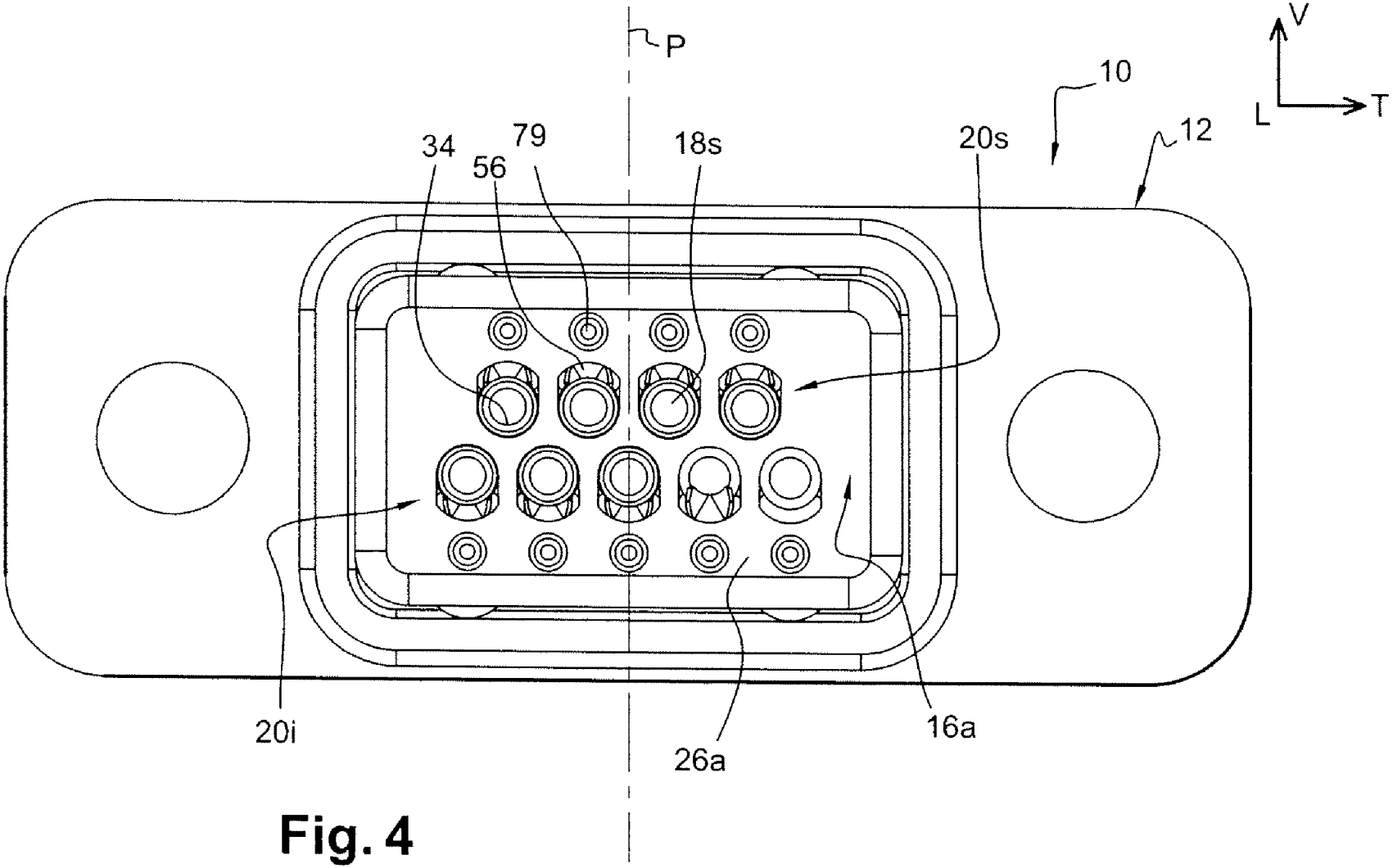
FIG. 4 is a face view that illustrates, from left to right, a first cell with no locking element or electrical contact element, a second cell adjacent to the first without its electrical contact element and subsequent "complete" cells according to an embodiment.

FIGS. 1B to 8 represent a connector 10 which presents a general symmetry of design relative to a median vertical longitudinal plane P of symmetry, which is indicated in FIG. 4.

As can be seen in FIGS. 2 and 3, the connector 10 may include a longitudinal tubular casing 12 which includes a rear section 12*a*, a front section 12*b* and a radially projecting intermediate section 12*c*. The intermediate section 12*c* may include two holes 14 (only one of which is represented in FIG. 2) for fixing the connector 10, for example to a panel of an electronic appliance (not represented).

The connector 10 may include an electrically insulating body 16 which may extend axially in the casing 12 and which may include a front part 16*a* and a rear part 16*b* that are separate from each other. The rear part 16*b* of the insulating body 16 may include two top protuberances 17*s* and two bottom protuberances 17*i*, each of which may cooperate with an annular internal wall of the casing 12 in order to retain the insulating body 16 in the casing 12.

The front part 16*b* of the insulating body 16 may include a shoulder 19 which may bear axially on an internal annular seat of the casing 12 of the connector 10, in order to axially retain the body 16 in the casing 12. The insulating body 16 may be, for example, produced by moulding in insulating plastic material.

The insulating body 16 may delimit, for example, a first top series of four parallel longitudinal cells 18*s* which are adjacent and aligned in a first transversal line. Similarly, the insulating body 16 may delimit a second bottom series of five parallel longitudinal cells 18*i* which are adjacent and aligned in a second transversal line, and which are "staggered" relative to the cells 18*s*. Each cell 18*i*, 18*s* may house an associated contact element 20*i*, 20*s* that may conduct electricity, each of which is axially retained in the associated cell by a locking element 22*i*, 22*s* respectively.

The assemblies of the top series, each of which may include a top cell 18*s*, a top electrical contact element 20*s* and an associated top locking element 22*s*, may be identical.

Similarly, the assemblies of the bottom series, each of which may include a bottom cell 18*i*, a bottom electrical contact element 20*i* and an associated bottom locking element 22*i*, may be identical to each other and identical to the assemblies of the top series.

Notably, all the electrical contact elements 20*i* and 20*s* may be electrical contact elements that are all identical with standardized dimensions. However, as illustrated by FIGS. 2 and 4, the assemblies of the top series may be oriented vertically in the opposite direction, or "mirror-wise", relative to the assemblies of the bottom series. In order to help in understanding the description, a single assembly of the top series will now be described.

Figure 6:
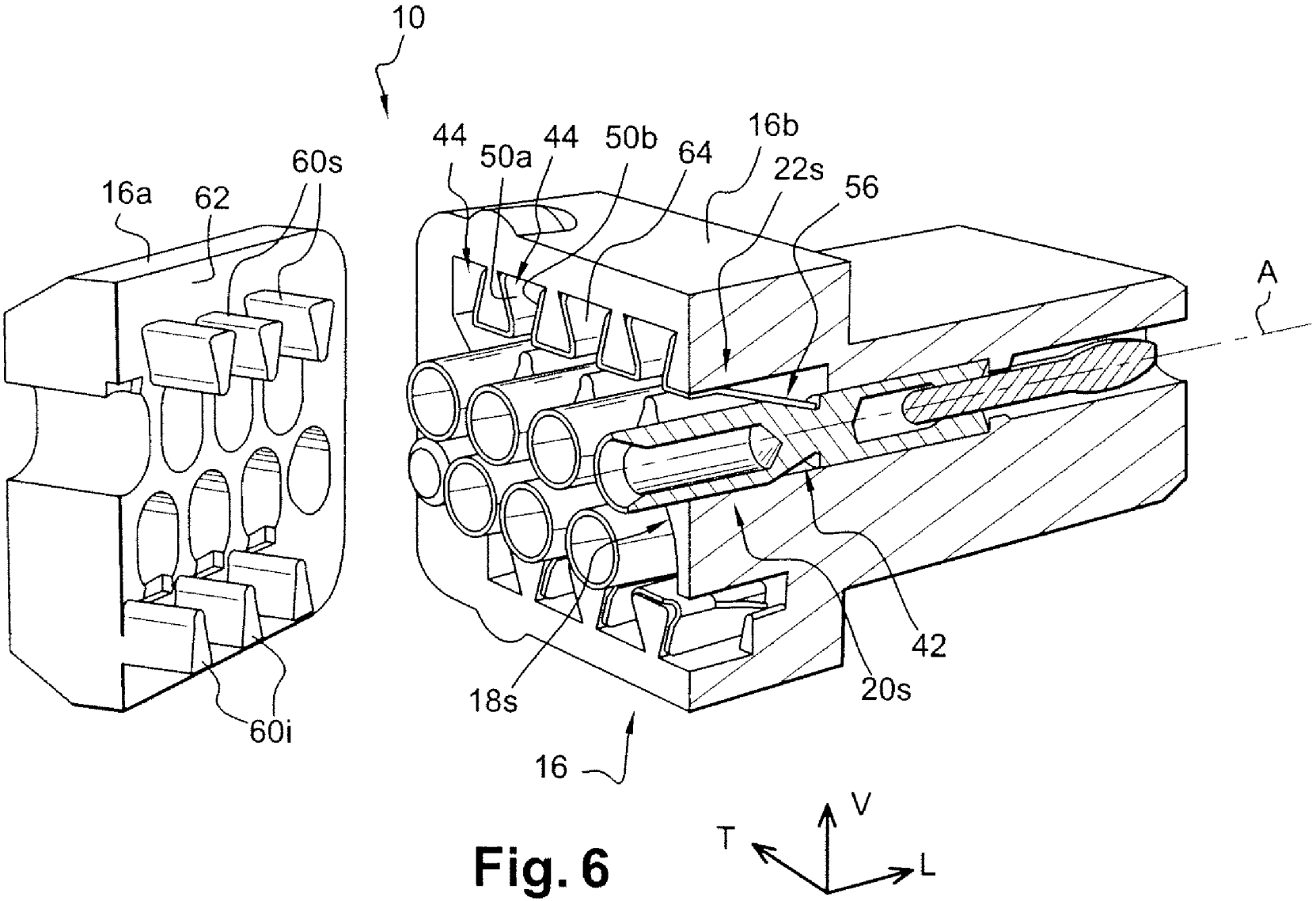
FIG. 6 is a perspective axial section view exploded axially and angularly about a vertical axis, illustrating locking elements, each of which comprises a locating base which is fixed to a tenon joint of the insulating body of the connector according to an embodiment.

As can be seen in FIGS. 3 and 6, the cell 18*s* may extend axially from back to front along a longitudinal axis A, from a rear section 24*a* opening axially into a rear vertical face 26*a* of the rear part 16*a* of the insulating body 16, as far as a front section 24*b* opening axially into a front vertical face 26*b* of the front part 16*b* of the insulating body 16, with an intermediate locking section 24*c*, called locking section.

In a complementary manner, the electrical contact element 20*s* associated with the cell 18*s* may extend axially in the cell

18*s*, and it may include a rear locking section 30*a* which may be received in the intermediate locking section 24*c* of the cell 18*s*, and a front section 30*b*.

The front free end of the front section 30*b* of the electrical contact element 20*s* may include an annular radial face 32 which may bear axially against an annular radial seat 34 of the rear section 24*b* of the cell 18*s*, in order to axially immobilize the electrical contact element 20*s* towards the front.

The electrical contact element 20*s* may include an electrical contact pin 36 which may extend axially towards the front from the front free end of the front section 30*b*, so that the electrical contact pin 36, in this case a "male", may be able to be electrically connected with a complementary electrical contact element (not represented), for example a "female" electrical contact element of a complementary electrical connector. The electrical contact pin 36 can be of male or female type.

The rear section 30*a* of the electrical contact element 20*s* may delimit a bore 38 of axis A in which may be fixed, for example by crimping, an electrical wire 40. The rear locking section 30*a* of the electrical contact element 20*s* may include an internal radial locking profile groove 42 to form a locking notch.

The locking element 22*s* may be designed to cooperate with the associated locking notch 42 of the electrical contact element 20*s*, to axially immobilize the electrical contact element 20*s* towards the rear. The locking element 22*s*, which is represented in detail in FIG. 5, may include a locating base 44 which may be fixed to a locating tenon joint 46 of the insulating body 16.

The locating base 44 may include a horizontal axial plate 48, from which may extend a first lateral wing 50*a* and a second lateral wing 50*b* which may be symmetrical and which may be folded upwards facing one another, so that the locating base 44 is of transversal section in the form of a female dovetail.

In a complementary manner, the tenon joint or lug 46, which may be formed by moulding in the front part 16*b* of the insulating body, may be of transversal section increasing towards the bottom in the form of a male dovetail dimensioned to be able to be received axially in an associated base 44.

The tenon joint 46 associated with a top cell may be arranged vertically above, and outside the cell 18*s*, and it may extend axially from rear to front from a transversal rear face 52 of the front part 16*b* of the insulating body 16 as far as a transversal internal face 54 with axial end stop which axially immobilizes the locking element 22*s* towards the front.

The locking element 22*s* may be able to be fixed to the tenon joint 46 by axial insertion of its base 44 on the associated tenon joint from back to front.

The first lateral wing 50*a* and the second lateral wing 50*b* of the base 44 can be substantially separated from each other by elastic deformation of the base 44, so that the first lateral wing 50*a* and the second lateral wing 50*b* constitute a clamp which elastically clamps the tenon joint 46 when the locking element 22*s* is fixed, or elastically fitted, on the tenon joint 46.

Such a fixing by elastic clamping may allow for a locking and a fixing of the locking element 22*s* onto the tenon joint 46 that is accurate, simple and offers a good resistance without play between the locking element 22*s* and the tenon joint 46. Furthermore, the locking element 22*s* may be made of metal, by cutting and bending a metal plate, which may allow for a metal-plastic cooperation between the locking element 22*s* and the tenon joint 46.

In an embodiment, the base 44 may be radially offset relative to the locking section 30*a* of the associated cell 18*s*, in a direction orthogonal to the first transversal line of alignment of the first top series of cells 18*s*, in this case vertically upwards. Such an arrangement of the base 44 of the locking element 22*s* may make it possible, advantageously, to reduce the diameter of the cell.

Figure 1B:
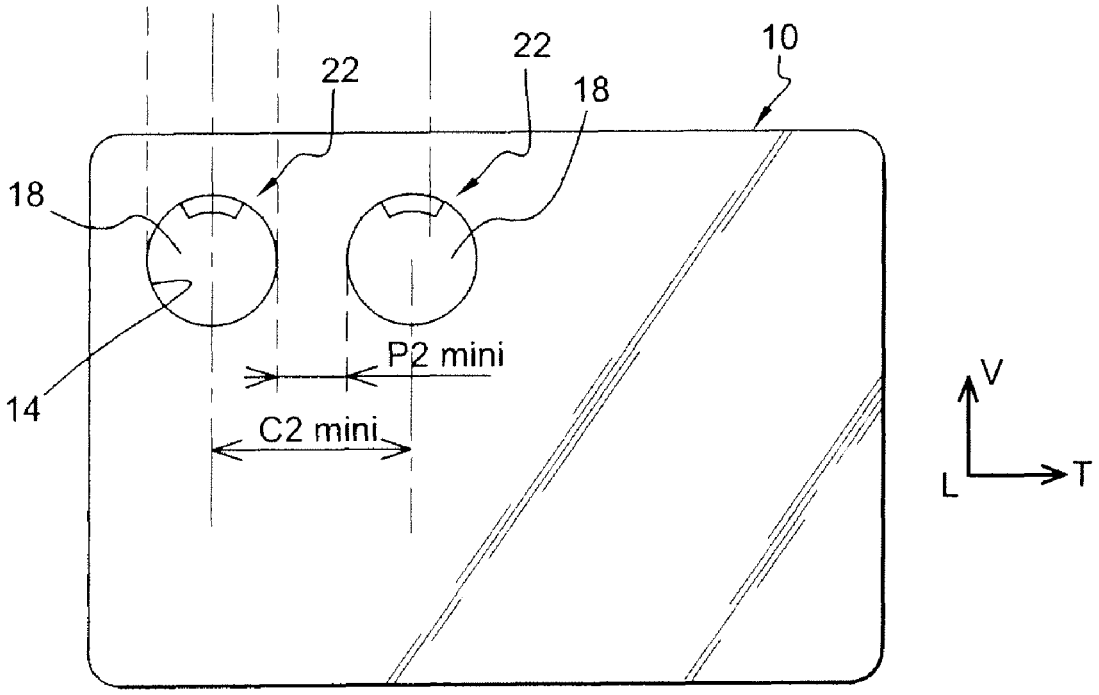
FIG. 1B is a diagrammatic view illustrating two adjacent cells of an electrical connector, each cell housing a locking finger of a locking element, with its base arranged outside the associated cell, for the locking of one and the same standard electrical contact element.

FIG. 1B represents a connector 10 according to an embodiment. The base of each locking element 22 is arranged outside the associated cell 18, so that the two cells 18, which are separated by a minimum portion of material P2mini which is equal to P1mini, have their axes spaced apart by a minimum distance C2mini which is less than C1mini, this reduction in footprint resulting from the reduction of the diameter D1 of the internal wall of the locking section of the cell which no longer houses a base socket of the locking element.

In an embodiment, as shown in FIGS. 3 and 6, the rear part 16*a* of the insulating body 16 may include a top series of terminals 60*s* and a bottom series of terminals 60*i*, each of which may extend axially towards the front from a front transversal radial face 62 of the rear part 16*a*. Each terminal 60*i*, 60*s* may be able to be fitted axially towards the front in a complementary recess 64 which may be transversally delimited between a lateral wing 50*b* of a first base 44 and a lateral wing 50*a* of a second base 44 adjacent to the first base, in order to immobilize the rear part 16*a* on the front part 16*b* of the insulating body 16. The locking element 22*s* may include an elastically deformable locking finger 56 which may extend axially towards the front and towards the bottom from the axial plate 48 of the base 44, and which may project radially inside the locking section 24*e* of the cell 18*s*.

As shown in FIGS. 3 and 5, the free end of the locking finger 56 may bear axially on an annular rear radial face 58 of the locking notch 42 of the locking section 30*a* of the associated electrical contact element 20*s*. The electrical contact element 20*s* may be retained axially towards the rear in the cell 18*s*.

In an embodiment, a tool 66 may be for unlocking the electrical contact element 20*s*, which is illustrated in FIGS. 8, 10A, 10B, 11 and 12. The tool 66 may include an unlocking rod 68 which may extend axially towards the front from a gripping sleeve 69 of the tool 66 and which may be produced by cutting from a metal plate 71.

Figure 7:
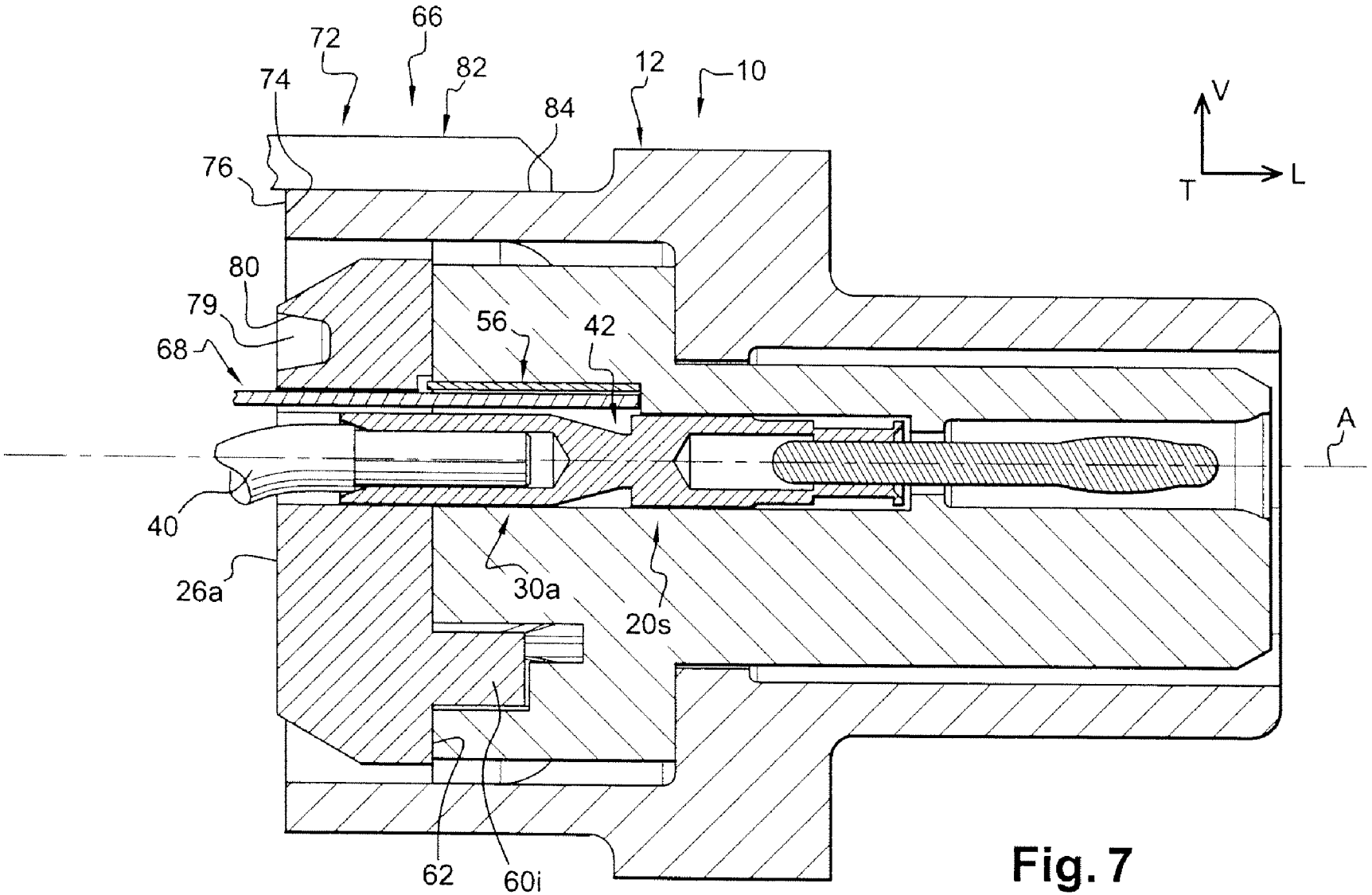
FIG. 7 is an axial cross section view similar to that of FIG. 3, representing the electrical contact element in an unlocked position according to an embodiment.
Figure 8:
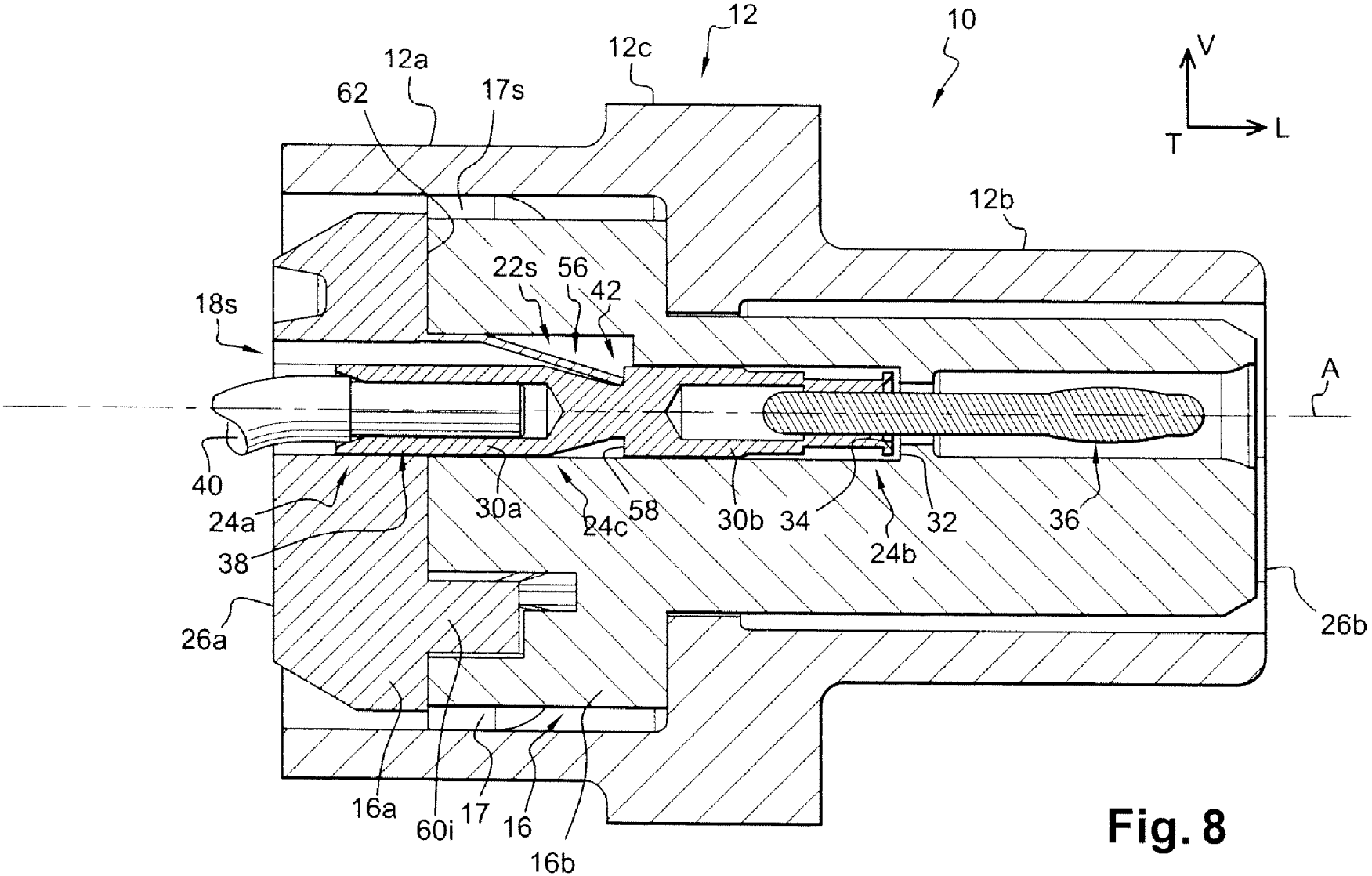
FIG. 8 is an axial cross section view similar to that of FIG. 3, representing a variant of the locking element according to an embodiment.
Figure 9:
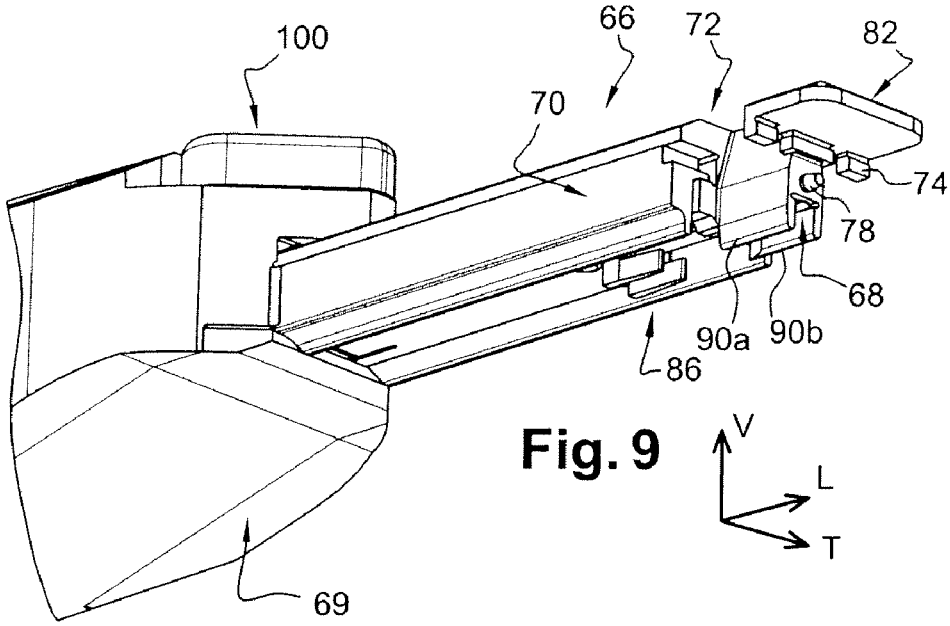
FIG. 9 is a partial view in perspective that illustrates a tool for unlocking an electrical contact element in a connector according to the invention by unlocking rod, which is represented here in a rear rest position according to an embodiment.
Figure 10A:
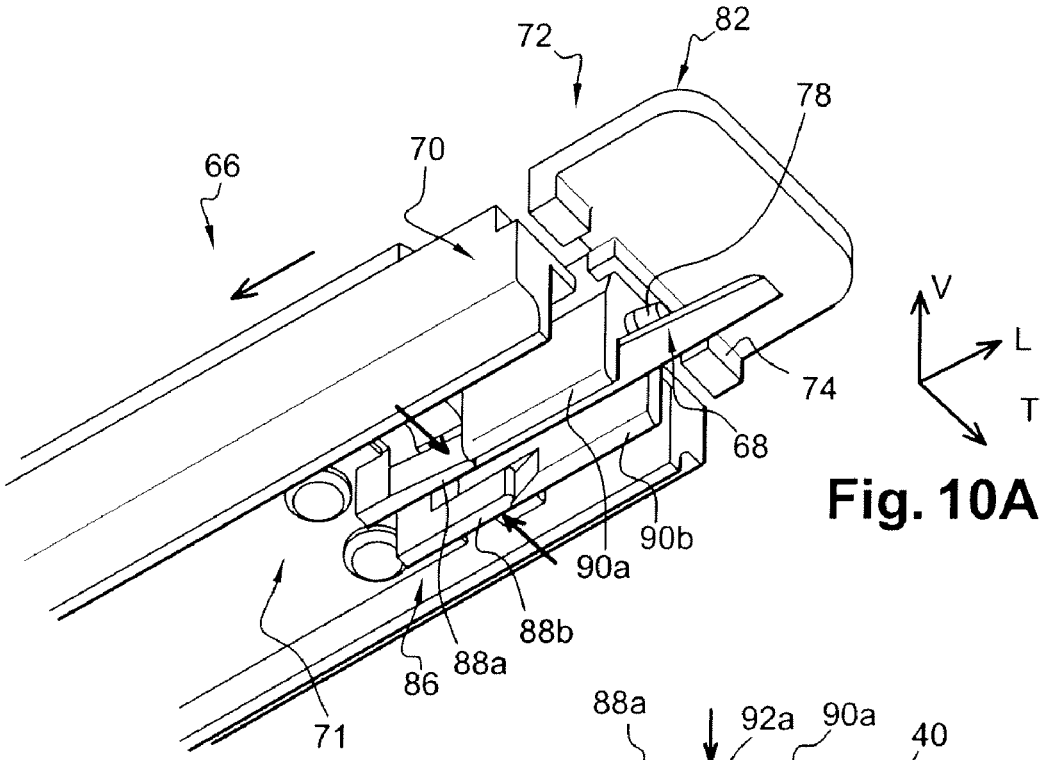
FIG. 10A is a view similar to that of FIG. 9 on a larger scale, which illustrates the tool of FIG. 9 whose unlocking rod occupies a front unlocking position and a moving slide which occupies a rear retracted position according to an embodiment.
Figure 11:
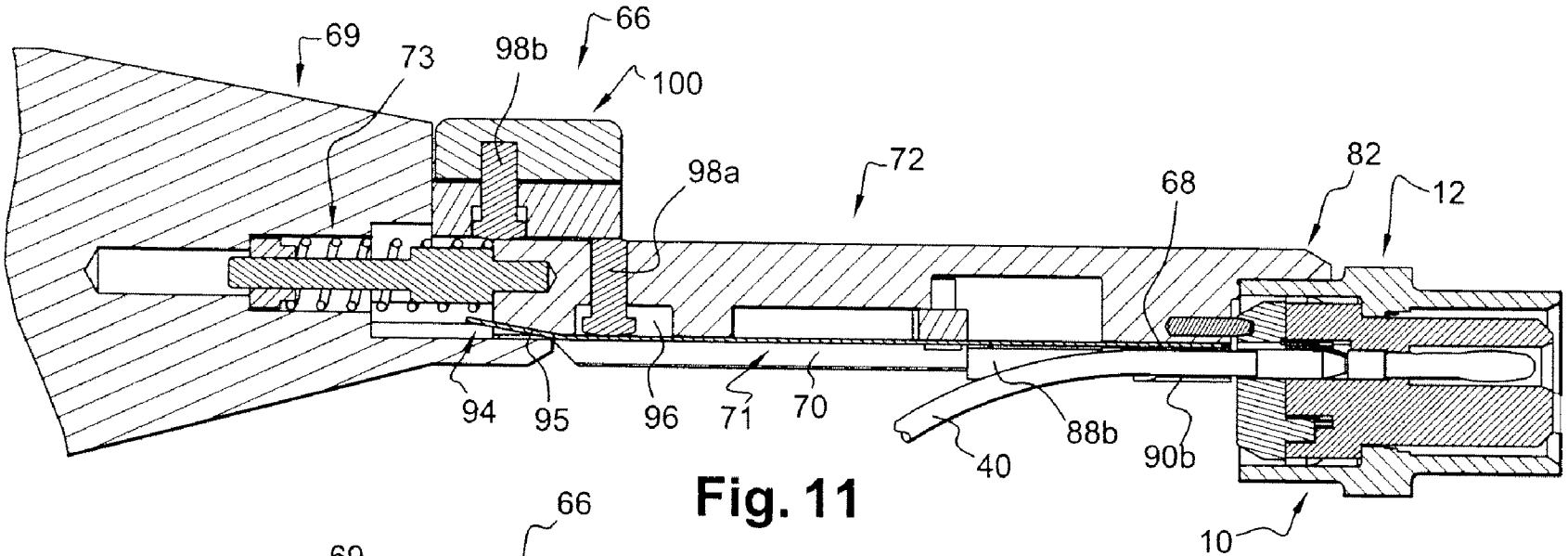
FIG. 11 is an axial cross section view which illustrates the rod of the tool in its rear rest position and the moving slide in its front rest position according to an embodiment.
Figure 12:
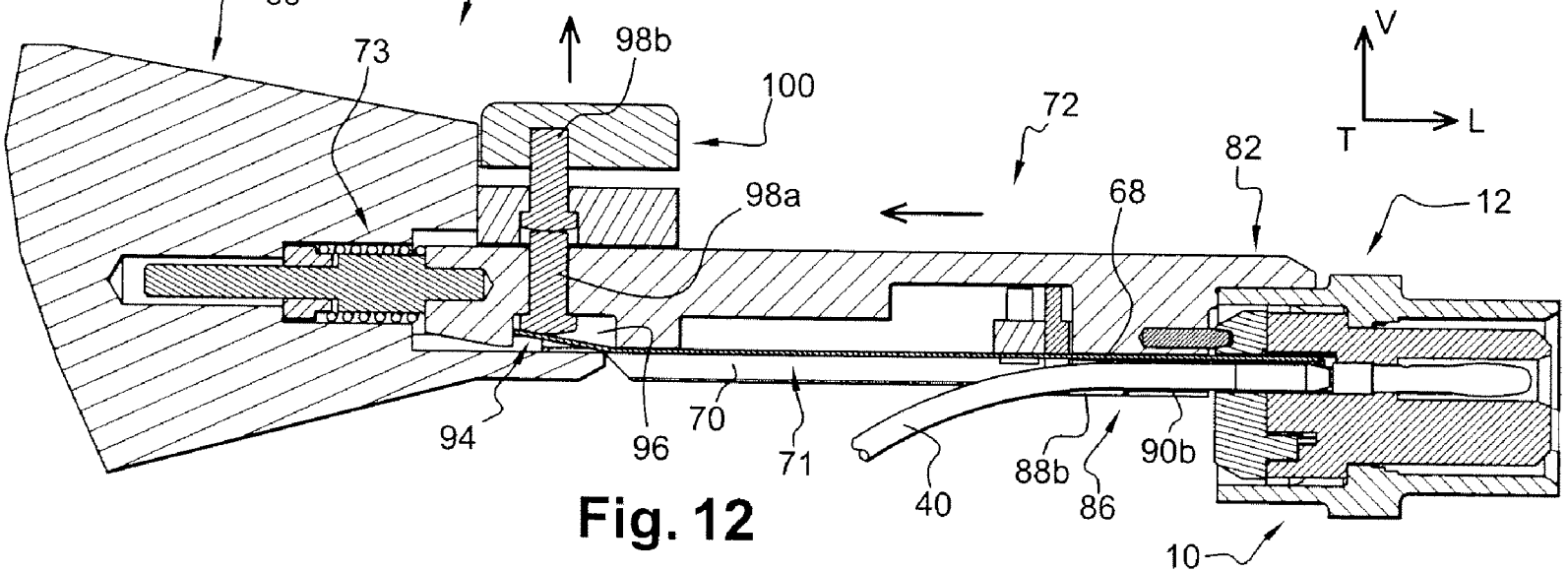
FIG. 12 is a view similar to that of FIG. 11, which illustrates the rod of the tool in its front unlocking position in a cell of the connector and the moving slide in its rear retracted position according to an embodiment.

The unlocking rod 68 may be able to be driven axially from back to front in the cell 18*s* from a rear rest position represented in FIGS. 9 and 11, to a front unlocking position represented in FIGS. 7, 10A and 12, in which the unlocking rod 68 may be radially inserted between the locking section 30*a* of the electrical contact element 20*s* and the locking finger 56.

As illustrated in FIG. 7, the unlocking rod 68, in its front unlocking position, may elastically deform the locking finger 56 to retract it out of the notch 42 of the locking section 30*a* of the electrical contact element 20*s*, in order to unlock the electrical contact element 20*s*. In an embodiment, the tool 66 may include a rail 70 which may extend axially towards the front and which may support the unlocking rod 68. The tool 66 may include a slide 72 which may be fitted to slide axially from front to back on the rail 70 between a front rest position towards which it may be elastically returned by an elastic mechanism 73, as illustrated in FIG. 11, and a rear retracted position, as illustrated in FIG. 12.

As can be seen in FIG. 7, the slide 72 may include a bearing transversal front face 74 which may be able to bear axially on a transversal rear face 76 of the casing 12 of the connector 10. When the unlocking rod 68 of the tool 66 is driven towards its front unlocking position in the cell 18*s*, the transversal rear face 76 of the casing 12 may oppose the displacement towards the front of the slide 72, which may be driven to slide towards the rear from its front rest position to its rear retracted position, in which the unlocking rod 68 may occupy its front unlocking position.

The tool 66 may include a positioning mechanism configured to position the unlocking rod 68, which may enable the unlocking rod 68 to be positioned facing the cell 18*s* of the connector 10. The positioning mechanism may include an indexing pin 78 which may extend axially towards the front from the transversal front face 74 of the slide 72. The pin 78 may be able to be received in a complementary recess 79 which may be provided in the transversal rear face 26*a* of the body 16 of the connector 10, to position the unlocking rod 68 transversally and axially relative to the cell 18*s*.

The tool 66 may include a horizontal angular positioning and orientation axial plate 82, which may extend towards the front from a front free end of the slide 72 orthogonally to the transversal front face 74 of the slide 72. The axial positioning plate 82 may be able to bear vertically on a top horizontal face 84 of the casing 12 of the connector 10, to position the unlocking rod 68 angularly relative to the cell 18*s*.

In an embodiment, the tool 66 may include a clamp 86 for gripping the wire 40 and extracting the electrical contact element 20*s* towards the rear. The clamp 86 may include two elastically deformable jaws 88*a*, 88*b* which may be supported by the fixed rail 70 of the tool 66 and which may be arranged behind the unlocking rod 68.

Figure 10B:
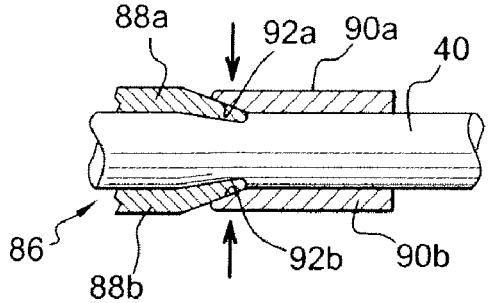
FIG. 10B is a detail view from below, which illustrates a gripping clamp arranged under the tool, in an electrical wire gripping position according to an embodiment.

The two jaws 88*a*, 88*b* may extend facing each other and they may be fitted to move one towards the other, between an open position represented in FIG. 9 and a closed gripping position, represented in FIGS. 10A and 10B, in which the two jaws 88*a*, 88*b* may be able to grip the wire 40 of the electrical contact element 20*s* by clamping.

In order to drive the clamp 86 towards its closed position, the slide 72 may include a first pusher 90*a* and a second pusher 90*b* which may extend axially facing each other and which may be arranged at the front of the clamp 86, either side of the unlocking rod 68.

As illustrated by the bottom view of FIG. 10B, the two pushers 90*a*, 90*b* may delimit an axial corridor guiding the wire 40, the facing internal axial faces of which each present a tapered rear section 92*a*, 92*b* respectively. When the slide 72 is driven towards the rear from its front rest position, each tapered section 92*a*, 92*b* may cooperate by bearing transversally with a jaw 90*a*, 90*b* associated with the clamp 86, in order to progressively drive the two jaws 90*a*, 90*b* into their gripping position.

The gripping position of the two jaws 90*a*, 90*b* may be reached at the instant when the slide 72 occupies its rear retracted position and when the unlocking rod 68 occupies its front unlocking position, so that the electrical contact element 20*s* may be able to be extracted from the cell 18*s* by displacement towards the rear of the tool 66.

The tool 66 may include a blocking mechanism configured to automatically block the slide 72 in its rear retracted position, in which the wire 40 may be maintained automatically gripped in the clamp 86. The blocking mechanism, illustrated in FIGS. 11 and 12, may include an elastically deformable tab 94, which may be produced by cutting and by bending in the metal plate 71. The tab 94 may extend axially upwards from front to back from the metal plate 71, so that the tab 94 may project vertically. When the slide 72 occupies its front rest position, illustrated in FIG. 11, a top face of the tab 94 may bear on a moving ramp 95 which may be formed by a bottom face of the slide 72.

Conversely, when the slide 72 occupies its rear retracted position, as illustrated in FIG. 12, the tab may occupy a position blocking the slide 72, in which the rear free end of the tab 94 may bear axially on a vertical face of a bottom recess 96 of the slide 72, so that the tab 94 may oppose the elastic return towards the front of the slide 72. In its blocking position, the tab 94 may elastically return upwards a first pin 98*a* which may be mounted to move vertically in a bore opening into the recess 96.

Similarly, the first pin 98*a* may drive upwards a second pin 98*b* which may be fitted to move vertically in the sleeve 69 of the tool 66 and which may be linked in displacement to a button 100. The button 100 may be a button for unblocking the slide 72 towards its front rest position. Thus, by vertically pressing down on the unblocking button 100, the tab 94 may be driven downwards via two pins 98*a*, 98*b*, so that the tab 94 no longer opposes the displacement by elastic return of the slide 72.

In a non-represented embodiment, the tool 66 may be incorporated in the connector 10. The unlocking rod 68 may be fitted to slide axially on the connector 10, from its rear rest position to its front unlocking position. The unlocking rod 68 may be, for example, supported by an annular ring which may be fitted to slide axially from back to front around the insulating body 16 of the connector 10.

In an embodiment, represented in FIG. 7, the locking finger 56 may be produced by moulding from material with the rear part 16*a* of the insulating body 16 of the connector 10. The locking finger 56 may extend axially towards the front and downwards from the front transversal radial face 62 of the rear part 16*a* of the insulating body 16, and it may project radially inside the locking section 24*c* of the cell 18*s*.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrical connector comprises:

an insulating body comprising a series of at least two parallel and adjacent longitudinal cells which are aligned, each cell being open axially and leading into a rear face of the insulating body;

a series of electrical contact elements, each of which comprises a locking section which comprises at least one locking notch which is configured to be received axially in a section, of one of the cells and to be axially immobilized therein;

a series of locking elements each of which is configured to retain axially, at least towards a rear, a locking section of an associated electrical contact element, each locking element comprising a locating base which is fixed axially relative to the insulating body and at least one locking finger, which is elastically deformable, and which extends from the locating base, which projects radially inside the locking section of an associated cell, and a free end of which is received in a locking notch of the associated electrical contact element to retain it axially, wherein the locating base of each locking element comprises:

a plate from which the locking finger extends towards a front, and a first wing and a second wing which are facing one another so that the locating base is in the form of a dovetail, and wherein each locating base is configured to be threaded axially onto a complementary part of the insulating body of the electrical connector.

2. The connector of claim 1 wherein the locating base of each locking element is fixed to a part of the insulating body of the electrical connector by cooperating complementary forms in order to retain the locking finger in the associated cell.

3. The connector of claim 1 wherein the first wing and the second wing of the locating base are configured to be substantially separated from each other by elastic deformation of the locating base, so that the first wing and the second wing constitute a clamp which is configured to elastically clamp the complementary part when the locking element is fixed, or elastically fitted, onto the complementary part.

4. The connector of claim 1 wherein each locking element is made of metal and each complementary fixing part is made of plastic.

5. The connector of claim 1 wherein each locking element is made by cutting and by bending a metal plate.

6. The connector of claim 1 wherein the locating base is radially offset relative to the locking section of the associated cell perpendicular to the cells.

7. The connector of claim 6 wherein the locating base of the locking element associated with the cells are aligned in a line parallel to the cells.

8. The connector of claim 1 wherein each locking finger extends axially at an oblique angle from back to front inside the associated cell, so that a front free end of each finger extends facing a rear radial face of the locking notch of the locking section of the associated electrical contact element.

* * * * *